US005907967A

United States Patent [19]

Kleinefeldt et al.

[11] Patent Number: 5,907,967

[45] Date of Patent: Jun. 1, 1999

[54] WIRE ROD COOLING

[75] Inventors: Georg Kleinefeldt, Ratingen; Klaus Hoffmann, Düsseldorf; Uwe Plociennik, Ratingen, all of Germany

[73] Assignee: SMS Schloemann-Siemag AG, Dusseldorf, Germany

[21] Appl. No.: 08/979,967

[22] Filed: Nov. 26, 1997

[30] Foreign Application Priority Data

Nov. 27, 1996 [DE] Germany ..... 196 49 022

[51] Int. Cl.[6] ..... B21H 1/22

[52] U.S. Cl. ..... 72/201

[58] Field of Search ..... 72/200, 201, 202, 72/234, 227

[56] References Cited

U.S. PATENT DOCUMENTS 4,274,273 6/1981 Fapiano et al. ..... 72/201

5,325,697 7/1994 Shore et al. ..... 72/234

FOREIGN PATENT DOCUMENTS 0 140 592 5/1985 European Pat. Off. .

0 560 115 9/1993 European Pat. Off. .

30 39 101 5/1982 Germany .

2 055 650 3/1981 United Kingdom .

*Primary Examiner*—Joseph J. Hail, III

*Assistant Examiner*—Rodney A. Butler

*Attorney, Agent, or Firm*—Herbert Dubno

[57] ABSTRACT

In the continuous rolling of wire from a heated billet in a continuous wire-rod mill in which the rolled product passes through the rolling stand of a roughing line and an intermediate line, the finish rolling is effected in at least one finish rolling line having double rolling stands with respective pairs of horizontal and vertical rolls. The double stands or units are spaced apart and along a portion of the spacing between them, rolling stretches are provided.

1 Claim, 6 Drawing Sheets

WIRE ROD COOLING

SPECIFICATION

1. Field of the Invention

Our present invention relates to a method of finish-rolling wire rod and to an apparatus for that purpose. More particularly, the invention relates to a finishing line or wire rod which has previously been rolled to approximately circular cross section in the usual roughing and intermediate rolling line and is then subjected to finish rolling in at least one finish-rolling line.

2. Background of the Invention

In the rolling of wire rod, for example, from billets, in a continuous wire-rod mill, the billet after heating is usually subjected to rolling in a roughing unit of the continuous rolling line, then in an intermediate unit and finally in at least one finishing unit. The roughing line, the intermediate line and the finishing lines thus form part of the continuous wire-rod mill and each of them may include one or more mill stands which effect the hot-rolling operation.

When the strand to be rolled enters the finishing line, it has already been prereduced to the point that it has an approximately circular cross section. In the finishing line or finishing lines, the workpiece can be subjected to a sequence of reduction stages, each involving generally a pair of roll stands with respectively horizontal and vertical rolls so that the final caliber of the wire rod is imparted to the workpiece and a circular cross section is ensured.

In the various stages of rolling as there is a reduction of cross section, there is an increases in the speed of travel of the wire rod and the successive stages operate under increasing end roll speeds. The rolling capacity of the continuous wire-rod mill is a function of the rolling speeds and, in particular, the final roll speed of the last of the finishing stages. As a practical matter, therefore, there has been a desire to maximize the end roll speed for the rolled product in the finishing line. However, problems are encountered when attempts are made to increase the end roll speed since the rolled speed depends upon the reduction stages which are provided in succession and in the past a temperature increase has been encountered with efforts to increase the roll speeds from reduction stage to reduction stage, leading to temperatures which are not tolerable or which may be destructive to the product as well as to the processing equipment.

It has been recognized heretofore that one can cool a workpiece between stages of hot rolling but since any rolling pattern has been associated with an increase in the spacing of the mill stands from one another and thus the amount of space occupied by the rolling lines, intervening cooling has generally been avoided as increasing the capital cost as well as the operating costs.

We have now found that earlier approaches have resulted in reduction or alteration of the steel quality and hence the quality of the products produced. When changes in dimension are desired, set-up changes were required at very high cost.

U.S. Pat. No. 4,182,148 discloses a finishing line for fine steel shapes in which the finishing segment encompassed four finishing units in two parallel rolling lines and each unit for each of the lines comprised a double stand having a vertical and a horizontal rolling stage each. Ahead and behind the finishing segment, diverters were provided which were capable of deflecting the rolled product from a feed conveyor into one or the other of the two lines and at the outlet from these lines into a common discharge roller conveyor. Each segment had a central drive with branching transmissions for the two units. The rolling lines were set up for alternative operation and there is no suggestion in this document of intervening cooling.

German patent document 44 26 930 A1 discloses a fine steel plant, especially a wire-rolling plant which is intended to optimize product quality and the output of the finishing line. In this approach, capital economies can be obtained in a comparatively small space without significant product interruption by providing the finishing line with at least one two-stand standardized rolling unit upstream or downstream of the finishing line. IN this system as well there is no suggestion of intermediate cooling.

German patent document DE 42 07 296 A1 describes a high output fine steel rolling line with rolling stands or units which each have a rolling line upstream thereof, at lest one intermediate line and the latter is followed by the finishing line. The finishing unit can allow one or more strands of the rolled product to be produced in the form of wire or rod stock with a round cross section of stainless steel or other alloy steel. The lines have at least two-stand after-rolling units which are provided downstream of the finishing units and between the finishing units and the after-rolling units a cooling and tempering unit can be provided for the rolled product.

OBJECTS OF THE INVENTION

It is, therefore, an object of the present invention to provide an improved method and apparatus for the finish rolling of wire rod in at least one finishing line so that the final roll feed and thus the capacity of the overall system can be increased without an impermissible increase in the temperature of the product or rolled goods and at the same time enable the rolling process to be flexible with respect to the rolling program, e.g. with reference to the handling of different material qualities and rolled product dimensions while at the same time reducing the maximum motor power or energy requirements for given stock dimensions.

Another object of the invention is to eliminate drawbacks of earlier systems.

SUMMARY OF THE INVENTION

These objects are attained, in accordance with the invention, by spacing apart the individual reduction stages of the finishing line and providing in the gap between any two of these stages and preferably in the gaps between all of these stages, at least over portions of the length of each gap, a cooling zone. As a result, in these gaps an intervening cooling is effected of the workpiece traveling from one reduction stage to a successive reduction stage of the finishing line. More particularly, a method of finished-rolling wire rod, according to the invention, can comprise the steps of:

passing wire rod to be finished rolled from an intermediate rolling line through a plurality of reduction stages in at least one finish rolling line of a continuous wire rod mill and in each of the reduction stages effecting reduction in a horizontal-roll stand and a vertical-roll stand with a reduction degree at each stage as a function of material quality and with a certain roll speed as a function of a rolling temperature set for the respective stage, the reduction stages being spaced apart along the finish rolling line; and effecting forced cooling of the wire rod at least along part of a distance between individual ones of the reduction stages, thereby increasing end roll speeds and optionally increasing degree of reduction for approximately a given rolling temperature at least at some of the reduction stages.

The process of the invention in a surprisingly simple and economical manner allows resolving the finishing line or stretch into a multiplicity of two-stand reduction stages or units which can significantly reduce the totality of the heating up to which the workpiece is subjected from pass to pass and over the total number of passes. This is of enormous importance on the one hand to achieving a higher end-roll speed and, on the other hand, certain rolled-product qualities so that the latter are obtained more quickly than is the case with state of the art rolling techniques in which, even in the finishing line, the stands are placed so close together that there is approximately no cooling possible between successive reduction stages.

Advantageously, the finishing part of the continuous wire rod mill of the invention is subdivided into two finishing lines or stretches each with a plurality of reduction stages and each reduction stage of which comprises two stands with respectively a pair of horizontal rolls and a pair of vertical rolls. In this case, a particularly intensive cooling is provided in the greater spacing between the finishing line.

In order to further increase the flexibility in the reduction determination for the individual stages or units, where a plurality of two-stand reduction stages are provided as described above, preferably the last stage is provided as a so-called sizing or calibration stage. It has been found to be advantageous, moreover, to provide each of the stages of the finishing line as the two-stand stages described previously wherein, one pair of rolls are horizontal rolls and the rolls of the other pair are vertical rolls.

The presence of a sizing stage ensures better tolerances for the final rolled product and the enhanced flexibility described above so simplifies the calibration of the rolled wire rod that the number of units required for calibration can be substantially reduced by comparison with earlier systems.

The resolution of the finishing line into a multiplicity of spaced-apart double-stand units can allow the use of motors and transmissions individual to such double-stand units so that more complex drive systems of earlier arrangements can be avoided.

Another advantage of the system of the invention is that certain of the units can be disabled or rendered inoperative when they are not required for a particular rolling operation, i.e. a reduction is not required at the particular unit, or maintenance must be carried out at the inoperative unit.

The set-up and revision of the line to accommodate changes in dimensions of the product or the rolling of different materials can be carried out simply by rendering the unit selectively operative or inoperative as the case may be. The line can more readily be adjusted to requirements and the power which must be supplied to the system can be held to a minimum for certain rolling requirements and materials. Furthermore, the ability to mount the units with greater precision and to provide more accurate guides for the workpiece can be ensured.

Because each unit can be separately adjusted, brought into operation or idled, according to the invention, the units can be controlled simply via their respective electric motors, i.e. by turning on and off the motors as may be required. Units which need not be in use can be prepared for the next rolling operation without time lost and by appropriate setting of the degree of reduction in the units which remain, the energy consumption of the motors which each operation can optimize.

The overall system can be more flexible than with earlier arrangements because the degree of reduction from stage to stage or unit to unit can be established within a wide range of matching and can be more readily accomplished with the reduction in the roughened and intermediate stages. Here again, the maximum power utilization for the motor can be reduced by comparison with prior art systems.

The apparatus for the finished rolling of wire can be at least one multi-unit finishing line with each unit comprised of two stands and forming a respective reduction stage with a pair of horizontal rolls and a pair of vertical rolls. The units have a comparatively large spacing in the system of the invention and in the region of at least a portion of the or each gap, intervening cooling can be carried out. A forced cooling with gas or liquid can be effected.

Preferably cooling is carried out in a plurality of these gaps or in each of these gaps.

The invention has been found to be especially effective in the production of stainless steel wire rod.

BRIEF DESCRIPTION OF THE DRAWING

The above and other objects, features, and advantages will become more readily apparent from the following description, reference being made to the accompanying drawing in which.

SPECIFIC DESCRIPTION

Figure 10:
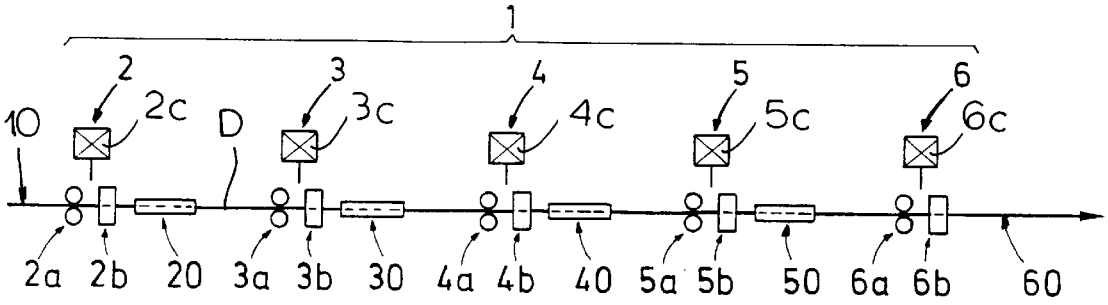
FIG. 10 is a diagram of a finishing line for practicing the method described in connection with FIG. 5.

Referring first to FIG. 10, in which, in somewhat block diagram form, a finishing line 1 of a continuous wire rod mill is shown, it will be apparent that this line comprises five finish-rolling units, 2, 3, 4, 5, 6, each of which is constituted of a respective stand 2*a* with a pair of vertical rolls 2*a*, 3*a*, 4*a*, 5*a*, 6*a*, respectively, and a stand with a pair of horizontal rolls 2*b*, 3*b*, 4*b*, 5*b*, 6*b*, respectively.

Each of the units 2, 3, 4, 5, 6 has a respective drive represented at 2*c*, 3*c*, 4*c*, 5*c* and 6*c*, respectively. The rolled product, from the intermediate mill, is represented at 10 and the double stands of each unit can have a common support or separate support, but each unit is spaced from the next unit by a comparatively large distance D, over a portion of which a cooling zone 20, 30, 40, 50 can be provided. A cooling stretch 60 may be provided downstream of the last unit 6. The cooling units 20, 30, 40, 50 may be force-cooling units using forced air or the like and the cooling units can extend over say 40 to 60% of the length D of the distance between the rolling units of the finishing line 1.

Figure 5:
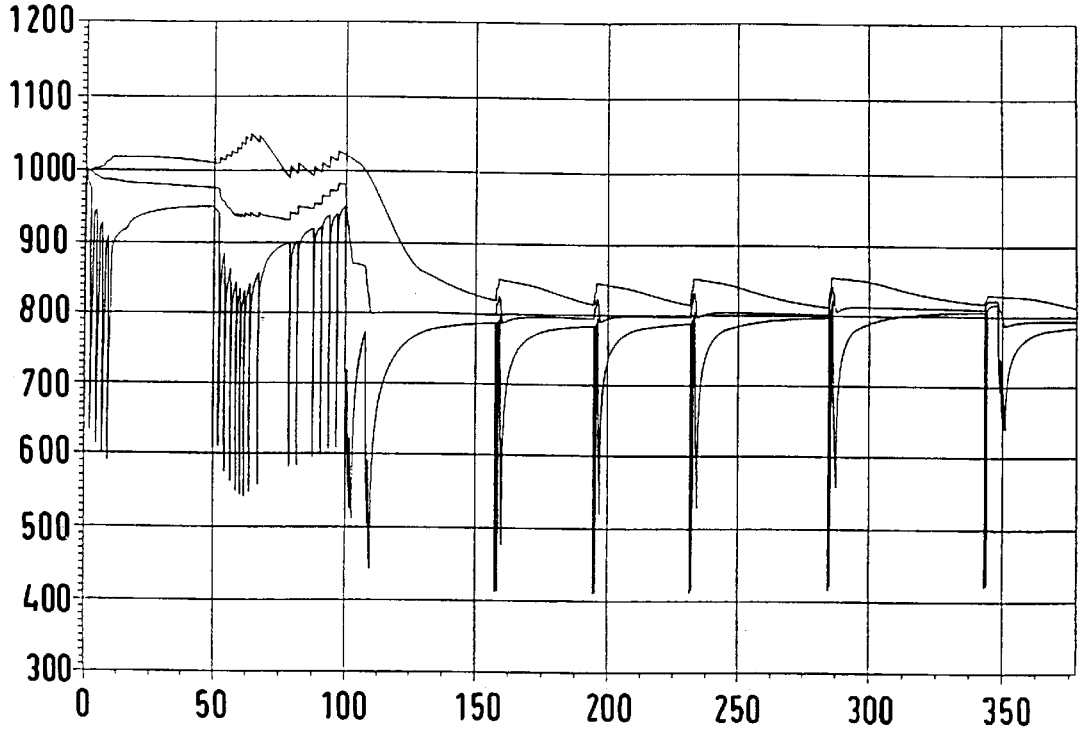
FIG. 5 is a graph of the temperature curve for an apparatus and rolling program as in FIG. 4 but with still greater spacing between the units of the finishing line, i.e. further extension of the finishing line.

The temperature pattern for the core, cross section and surface is reduced by comparison with finish-rolling systems using corresponding numbers of units and can correspond to the temperature diagram of FIG. 5. The latter has been found to provide an optimum attainment of the objects of this invention.

Figure 11:
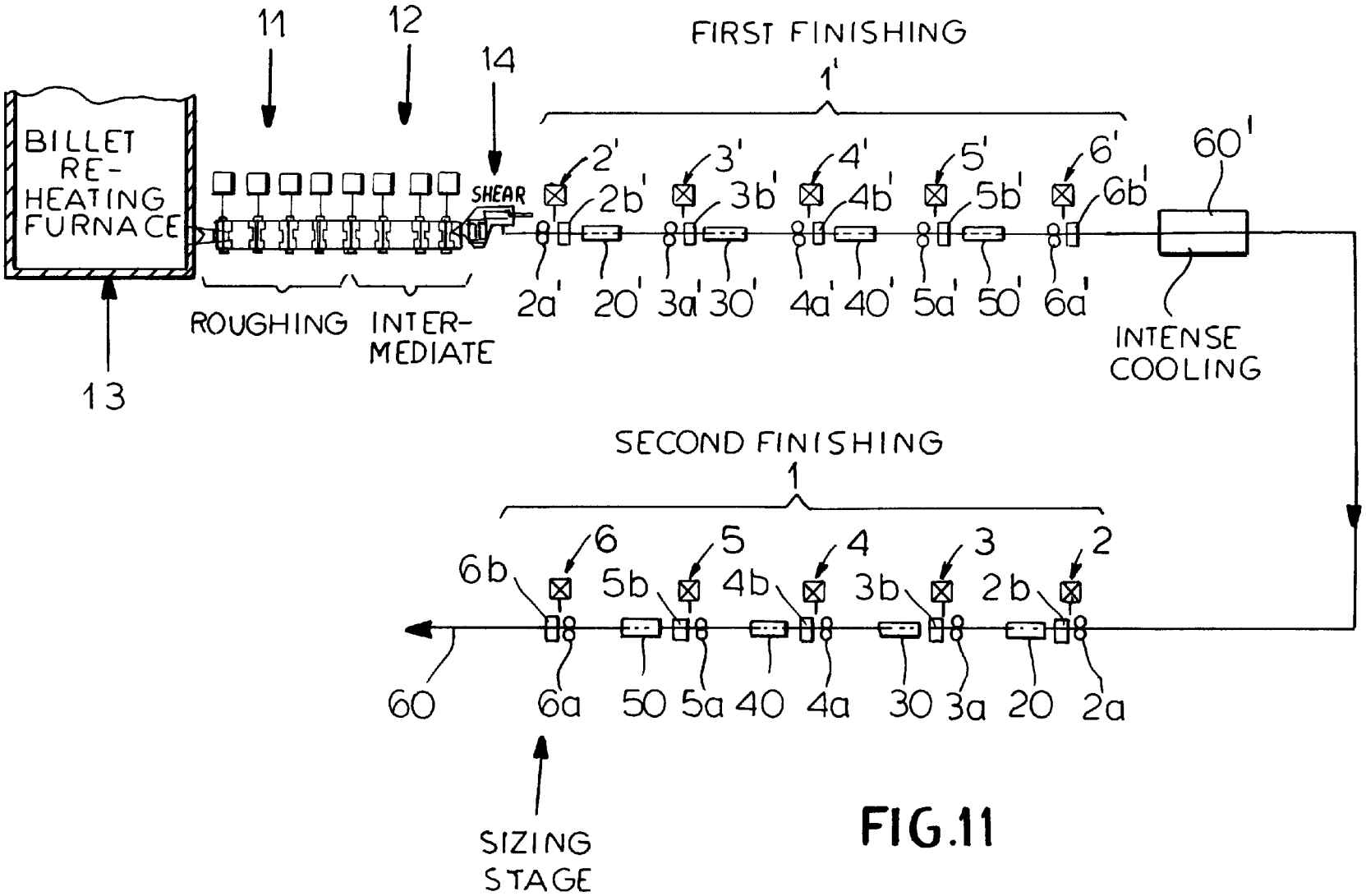
FIG. 11 is a diagram showing a continuous wire rod mill of the invention.

FIG. 11 shows the principles of this invention still further and in this case is upstream of the finishing line 1 which can correspond to that described with respect to FIG. 10, there is a first finishing line 1' and an intense cooling unit 60' in the extended space between the first and second finishing lines 1' and 1, respectively.

The first finishing line can have finishing roll units 2' and 6', each of which may be a double stand or provided with two stands having a pair of vertical rolls 2*a*'–6*a*' immediately followed by a pair of horizontal rolls 2*b*'–6*b*'.

In the gaps between the units 2'–6', cooling units 20'–50' can be provided corresponding to the cooling units 20–50.

The final double-stand stage 6 may be provided as a sizing stage as has been labeled in FIG. 11.

Upstream of the finishing lines, is a roughing line 11 and an intermediate rolling line 12 as is conventional in continuous wire rod mills and the billet can be supplied to the roughing and intermediate mill from a billet reheating furnace 13. A shear 14, as is also conventional in the art, may be provided to cut off the leading or trailing ends of the rolled stock where these ends may contain a high degree of defects.

The graphs of FIGS. 1–9 are temperature diagrams for the rolling of wire rod utilizing a roughing rolling line, an intermediate rolling line and a finishing line and illustrated the results obtained with operation of the finishing line at different rolling speeds. In each case, the abscissa represents the length of the line in meters while the ordinate shows the temperature of the stock in degrees centigrade. Each diagram shows three curves disposed one below another and respectively representing the temperature in the core of the rolled stock, the mean temperature over the total cross section, and the temperature at the surface of the rolled stock.

In FIGS. 1–4 the temperature characteristic has been shown for the rolling of tire wire in which the roughing line occupies the distance between the zero and 50 meter marks, the wire is rolled in the intermediate line between 50 and 150 m and the wire is then rolled in a finishing line consisting of eight double-stand units over the length between 150 and 250 m. The final diameter of the wire is in each case 5.5 mm.

Figure 1:
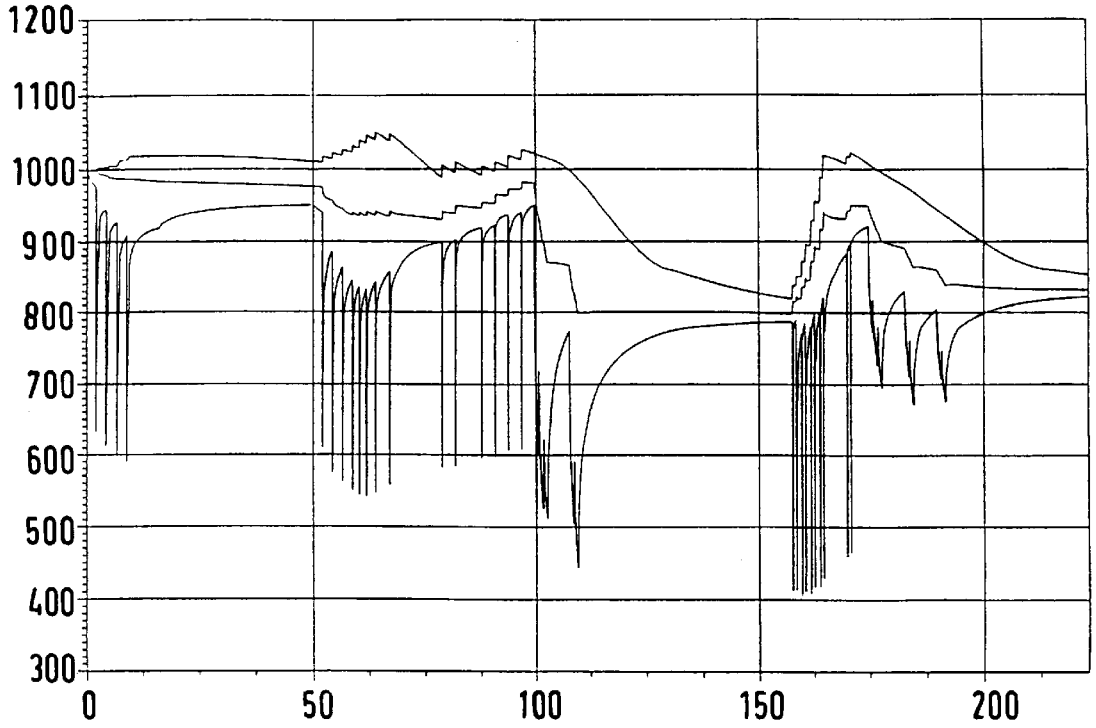
FIG. 1 is a temperature curve for a rolled product in the course of travel through a roughening line, an intermediate line and a multi-unit finishing line where the inlet speed (EG)=0.53 m/s, and the end roll speed (EWG)=105 m/s.

The core temperature is as illustrated in FIG. 1 at entry of the rolled product to the first roughing stand is 1000° C. and at the beginning of the intermediate rolling at about 66 m reaches a temperature peak of 150° C. When the wire leaves the last of the intermediate roll stands, the core temperature has fallen to about 825° C. and in the eight unit finishing line at about 169 m has risen to 1035° C. and by cooling after the last stand and this finishing line is reduced to about 855° C. The greatest temperature fluctuations are naturally found with surface temperatures with differences approximating 300° C. for individual cooling stages.

Figure 2:
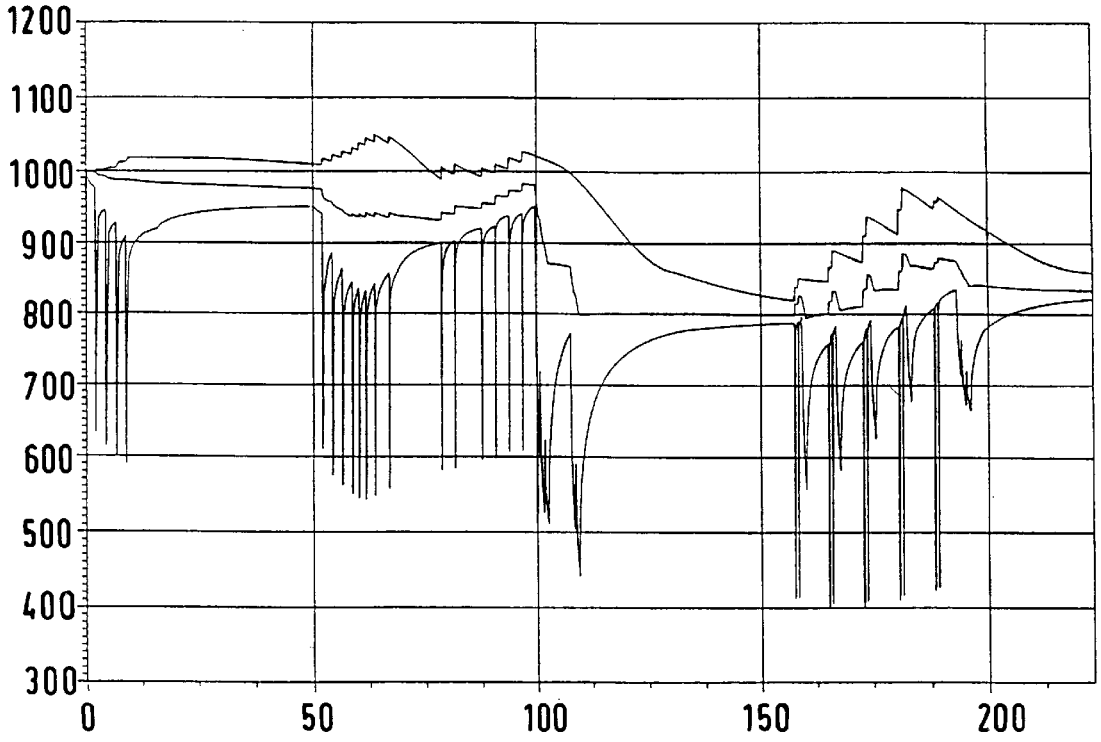
FIG. 2 is a temperature curve for the same apparatus and the same rolling program wherein, however, the units of the finishing line have been spread out and an intervening cooling is provided, EG=0.53 m/s, EWG=105 m/s.

In FIG. 2 the boundary conditions in total length of the line up to 150 m mark correspond to those of FIG. 1. However, distinguishing from FIG. 1, the finishing line of FIG. 2 is comprised of five double-stand units with intervening cooling. The core temperature in the rolled product is on an average lower by about 70° C., namely, from 1035° C. of FIG. 1 to the 965° C. of FIG. 2. The end temperature at the 225 m point along the line is 855° C. in the mean cross section temperature and 825° C. for the surface temperature. The temperature curves of FIGS. 1 and 2 correspond in end-roll speed and otherwise identical parameters with respect to material quality and the rolling program is of 105 m/s.

Figure 3:
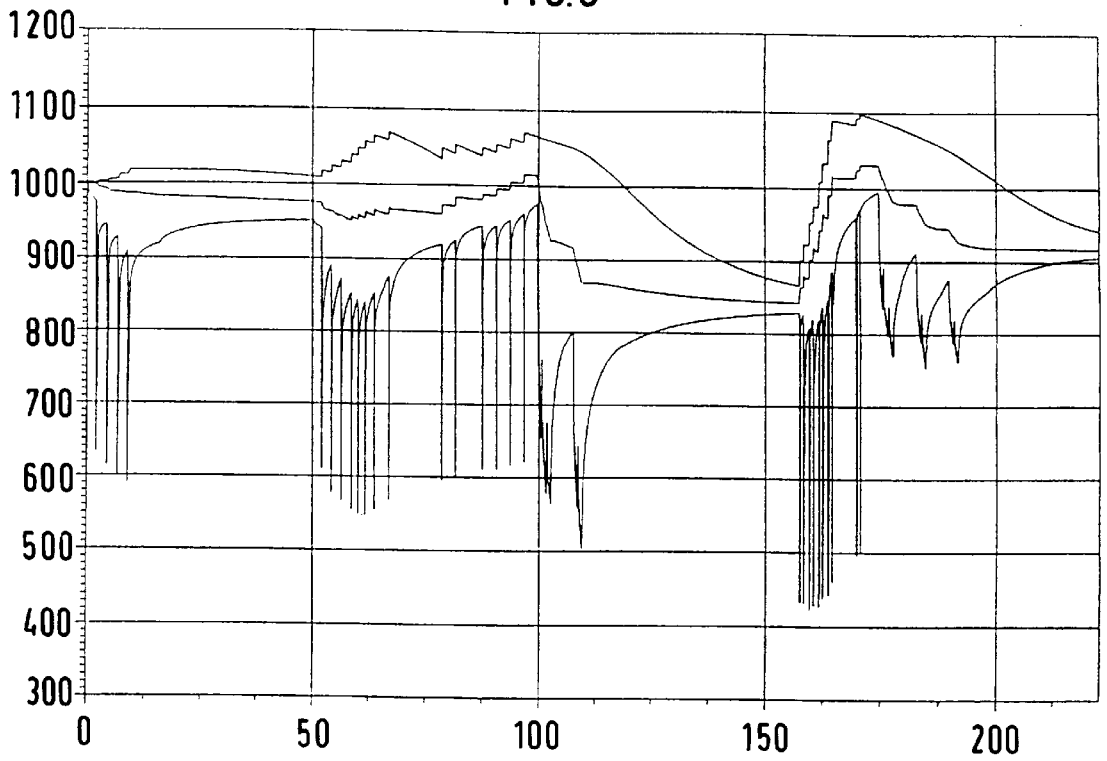
FIG. 3 is a temperature curve for the same apparatus and rolling program, as FIG. 1, however for an EWG=150 m/s.
Figure 4:
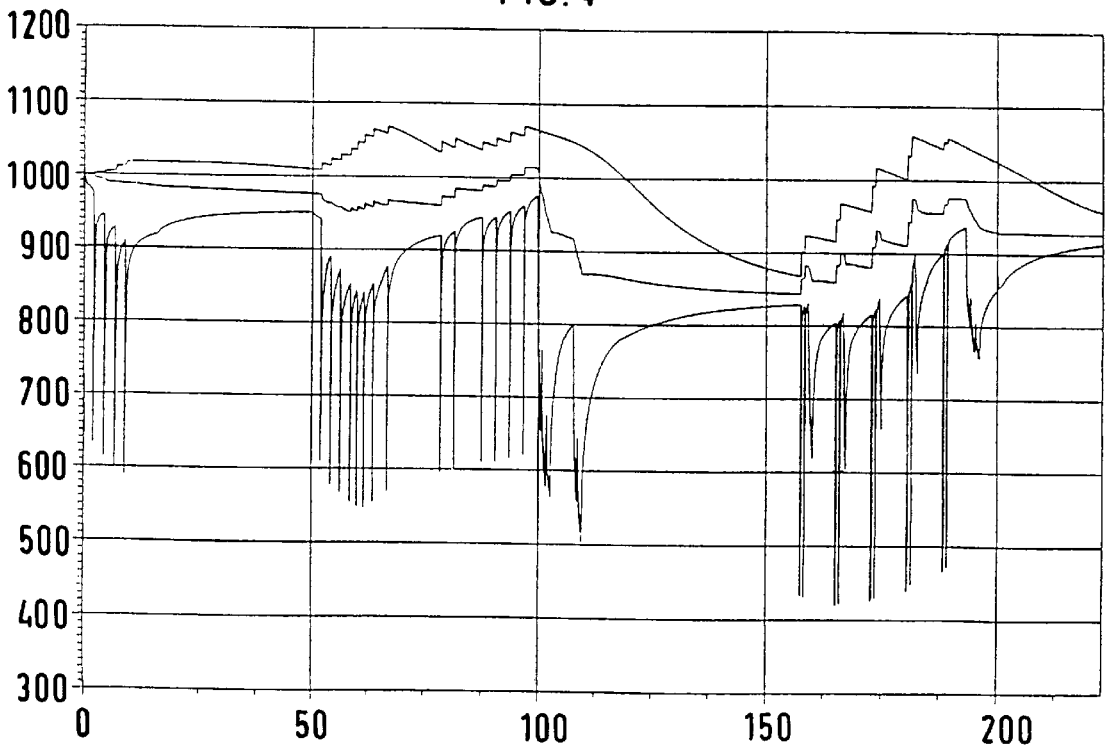
FIG. 4 is the temperature graph for the same apparatus and rolling program as in FIG. 2 but with EWG=150 m/s.

FIGS. 3 and 4 provide temperature graphs with the identical resulting program, starting material and final product 1 with a roll speed of 150 m/s. In the intermediate line a maximum temperature of 1070° C. is reached which is reduced upon entry of the rolled product into the finishing line to 870° C. at the core, 845° C. for the mean cross section temperature and 830° surface temperature in a plurality of cooling stages. By resolving the finishing line into spaced-apart double-stand units with intervening cooling, with the identical production parameters, a maximum core temperature in the finishing line can be held to over a length of 180 m of this line so that it does not exceed 1060° C. Where the product is discharged from the last stand of the finishing line, it can have a core temperature of 960° C., a mean cross section temperature of 940° C. and a surface temperature of 925° C.

FIG. 5 shows a typical graph of the core, mean cross section and surface temperatures, illustrating the positive effects of the process and apparatus of the invention. In this case, the five double-stand units of FIG. 10 are used over a stretch of 150 to 350 m of the continuous wire-rolling mill with an average spacing of 40 m between units and with intervening cooling. The core temperature reaches its peak for example at 280 m of 865° C. and the mean cross section temperature varies about the 800° C. level. The parameters are similar to those of FIGS. 1–4 although the rolling speed amounts of 150 m/s.

Figure 6:
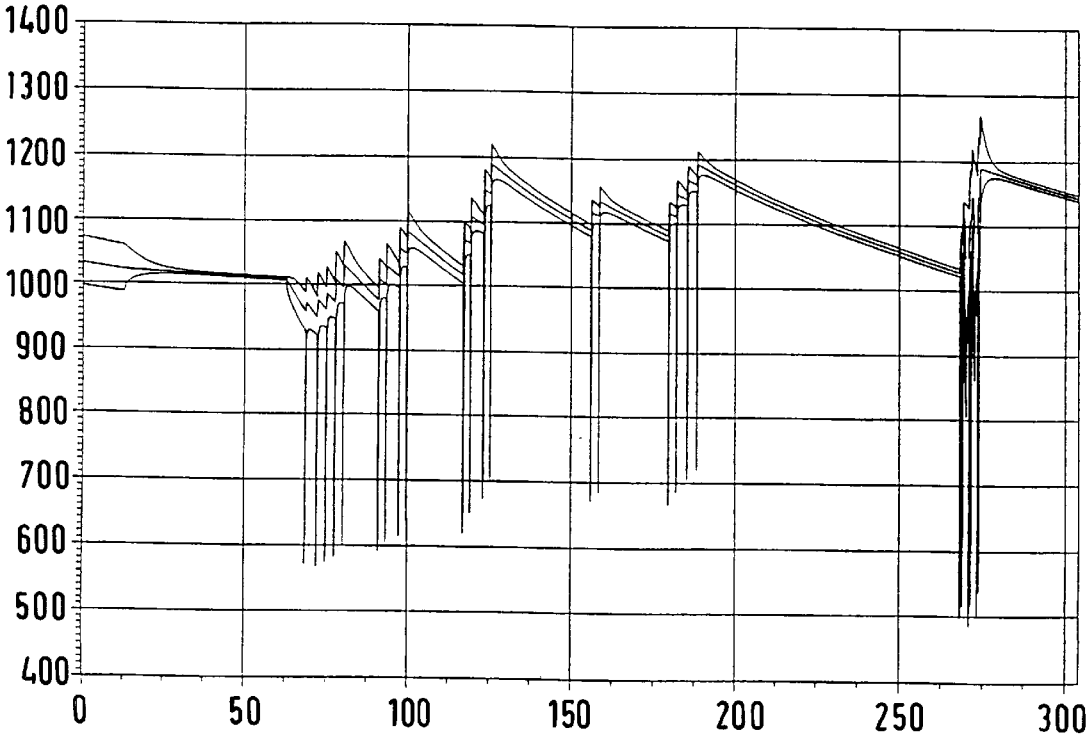
FIG. 6 is a graph of the temperature curves of a stainless steel line EG=2.4 m/s, EWG=2–m/s.

FIG. 6 represents a temperature simulation for a stainless steel rolling mill in which the product is a nickel-based alloy with a rolling speed of 20 m/s. The temperature peak in the finishing line is at about the 275 m mark and amounts to 1270° C.

Figure 7:
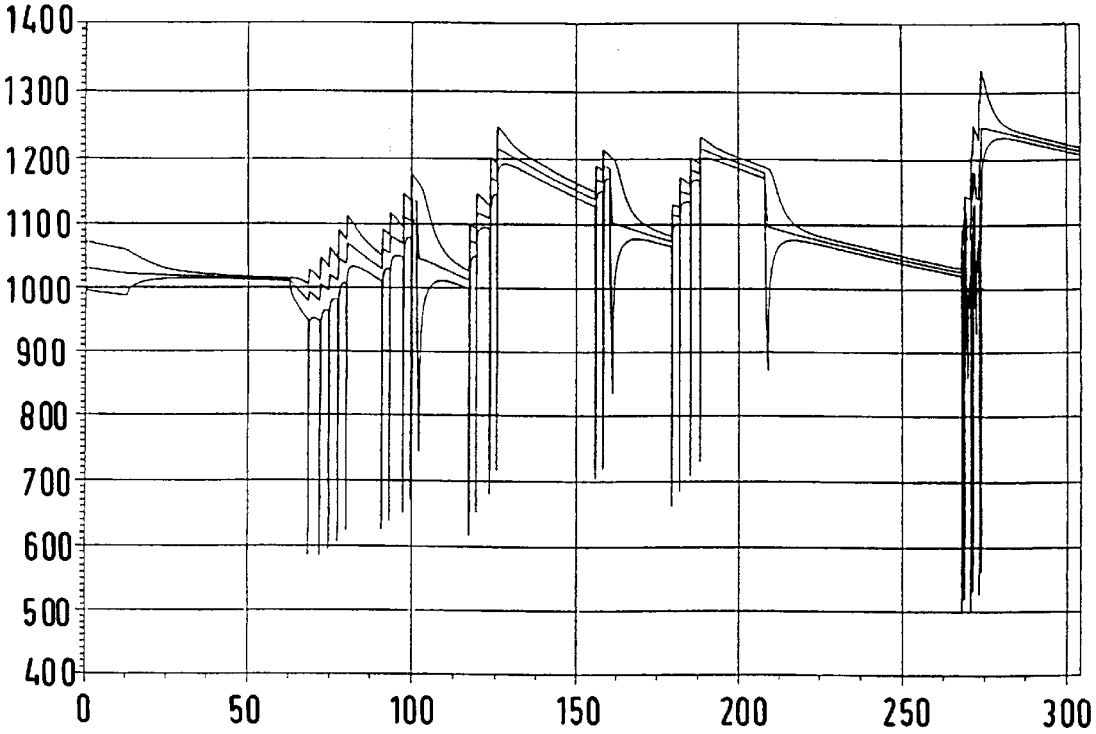
FIG. 7 is a graph of the temperature curves of FIG. 6 but for EWG=30 m/s.

FIG. 7 shows the same rolling process as FIG. 6 but with an end rolling speed of 30 m/s. The temperature peak in the finishing line at the 275 m mark is in the region of 1340° C.

Figure 8:
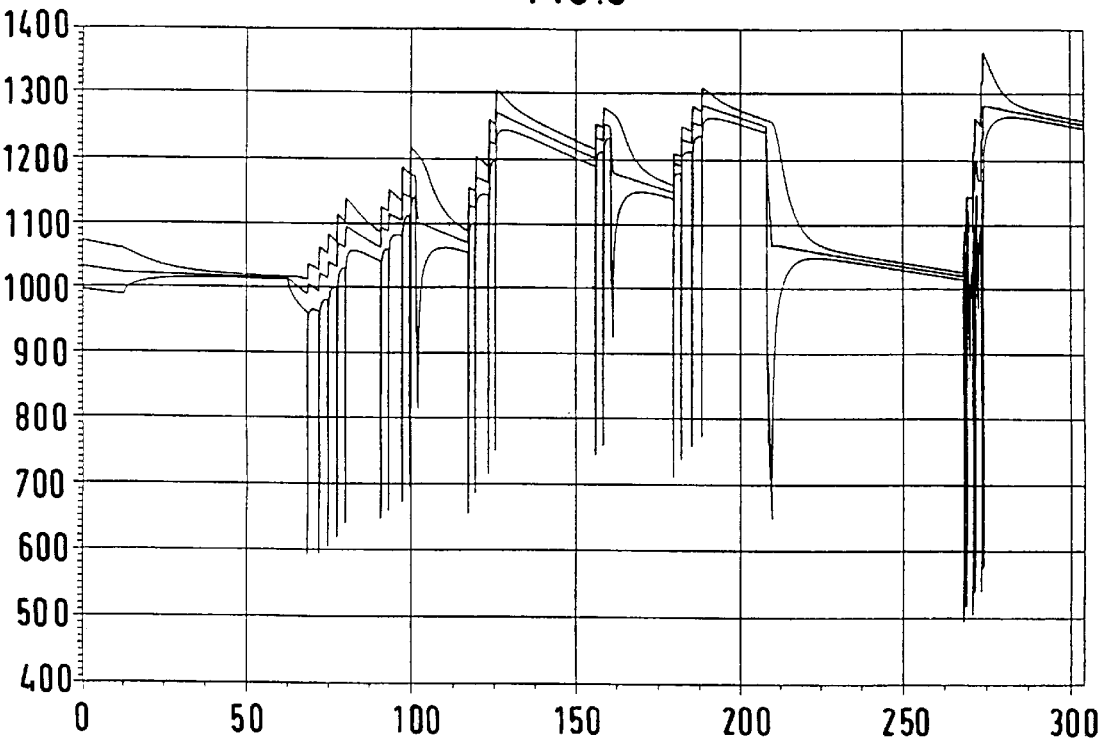
FIG. 8 is a graph of the temperature curves of FIG. 6 but for EWG=40 m/s.

A further increase in the end rolling speed to 40 m/s according to FIG. 8 gives a core temperature of 1305° C. at about 125 m in the intermediate line and of about 1310° C. at about 170 m. In the finishing line a temperature peak of about 270 m of 1360° C. is reached.

Figure 9:
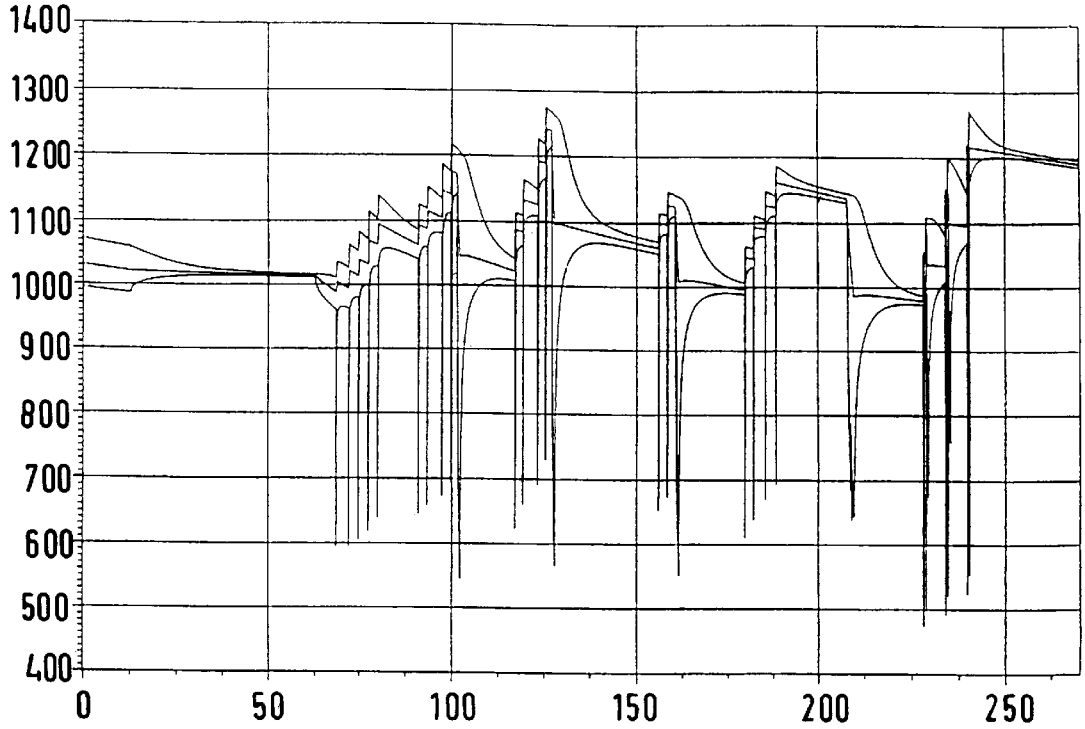
FIG. 9 is a graph of the temperature curves of FIG. 8 but with the units of the finishing line spread out and greater intervening cooling between these units.

FIG. 9 represents the results with three spaced-apart double-stand units with strong cooling between them in the finishing line and indicates a reduction of the peak temperature at about 240 m to 1275° C.

It will be apparent that with this intermediate cooling between the double stands of the finishing line and the spacing of these units apart is significantly higher end rolling speeds can be obtained with optionally higher degrees of reduction and approximately the same rolling temperature or reduced rolling temperatures.

Furthermore, the finishing line can be more readily matched to roughing and intermediate lines and the economics of the system enhanced in accordance with the invention.

We claim:

1. A method of rolling wire comprising the steps of:

reheating a metal billet to a hot rolling temperature;

rolling the heated billet in a succession of rolling stands of a rolling line;

thereafter rolling a rolled product from said rolling line in a multiplicity of rolling stands of an intermediate line to produce wire rod;

thereafter passing wire rod continuously from said intermediate line through a multiplicity of two-stand reduction stages in a first finish rolling line;

in each of said two-stand reduction stages effecting reduction in a horizontal-roll stand and a vertical-roll stand with a reduction degree at each stage as a function of material quality and with a certain roll speed as a function of a rolling temperature set for the respective stage, said reduction stages being spaced apart along said first finish rolling line;

effecting forced cooling of said wire rod at least along part of a distance between individual ones of said reduction stages, thereby increasing end roll speeds and optionally increasing degree of reduction for approximately a given rolling temperature at least at some of said reduction stages;

intensively cooling a rolled product of said first finish rolling line in an intensive-cooling stage;

thereafter passing the rolled product from said intensive cooling stage continuously from said intermediate line through a multiplicity of two-stand reduction stages in a second finish rolling line to produce rolled wire;

in each of said two-stand reduction stages of said second finish rolling line effecting reduction in a horizontal-roll stand and a vertical-roll stand with a reduction degree at each stage of said second finish rolling line as a function of material quality and with a certain roll speed as a function of a rolling temperature set for the respective stage, said reduction stages of said second finish rolling line being spaced apart along said second finish rolling line;

effecting forced cooling of said wire rod at least along part of a distance between individual ones of said reduction stages of said second finish rolling line, thereby increasing end roll speeds and optionally increasing degree of reduction for approximately a given rolling temperature at least at some of said reduction stages of said second finish rolling line;

operating a last of said two-stand reduction stages of said second finish rolling line as a sizing stage; and controlling said finish rolling lines to selectively enable and disable selective ones of said two-stand reduction stages of said rolling lines to accommodate changes in dimensions of a product produced or rolling of different materials.

* * * * *